United States Patent [19]

Vecho, Jr.

[11] 4,063,444

[45] Dec. 20, 1977

[54] OFFSET PIPE BENDING DEVICE

[76] Inventor: John B. Vecho, Jr., 1223 Country Club Road, Monongahela, Pa. 15063

[21] Appl. No.: 735,496

[22] Filed: Oct. 26, 1976

[51] Int. Cl.[2] ..... B21D 7/02

[52] U.S. Cl. ..... 72/459; 33/137 R; 72/32

[58] Field of Search ..... 72/458, 32, 36, 459; 33/137 R

[56] References Cited

U.S. PATENT DOCUMENTS

| | | | |
|---|---|---|---|
| 2,887,917 | 5/1959 | Kowal | 72/36 |
| 2,955,495 | 10/1960 | Stirling | 72/306 |
| 3,063,314 | 11/1962 | Benfield | 72/458 |
| 3,194,038 | 7/1965 | Small | 72/459 |
| 3,470,574 | 10/1969 | Heitman | 33/137 R |

*Primary Examiner*—Leon Gilden
*Assistant Examiner*—Gene P. Crosby
*Attorney, Agent, or Firm*—Buell, Blenko & Ziesenheim

[57] ABSTRACT

An improvement in a pipe bending device to predetermine the offset distance without removing the pipe from the bender. An adhesive tape with incremental markings thereon is applied on the handle of the pipe bender in a manner so that a sight line intersects the handle at the incremental mark indicating the amount of offset desired after the first bend is made.

4 Claims, 4 Drawing Figures

Figures 1, 2A, 2B, 3:
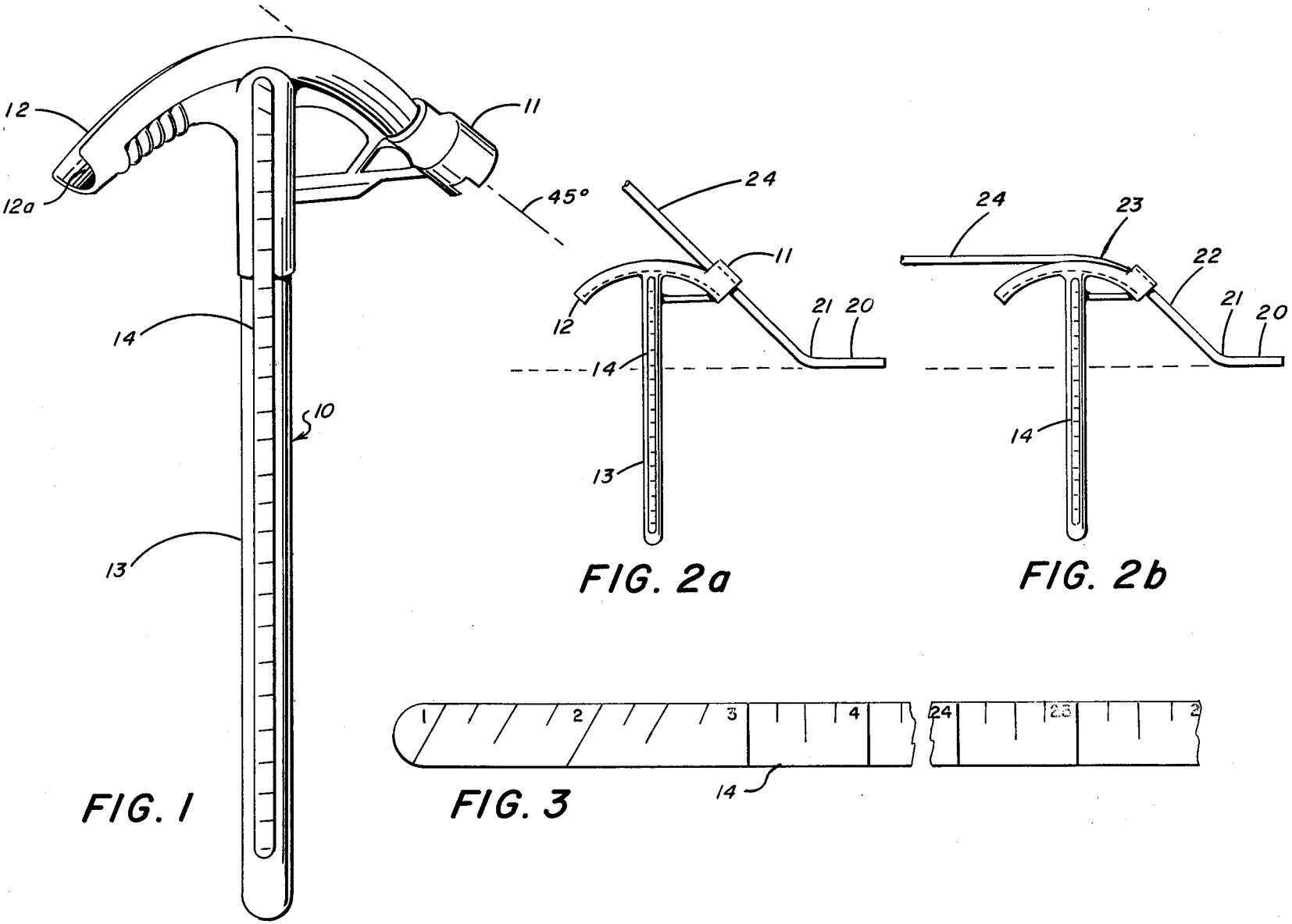

20
21
22
23
24
14

20
21
11
24
12
14
13

45°
11
10
14
13
12
12a 1
2
3
4
14

OFFSET PIPE BENDING DEVICE

In the construction industry it is necessary to bend pipe at the construction site. There are many devices to do this; some of which are operated by manual, hydraulic, pneumatic, or electrical power. Particularly in the electrical construction industry it is necessary to bend large quantities of thin walled conduit. Because this conduit is used to carry and protect electrical wiring it is found throughout all modern buildings. While many sizes of electrical conduits are used, typically conduits having diameters of 1 inch or less are manually bent into shape. Because of the many conduits of this type used in a single building an electrican requires accurate and easy means to bend this conduit. Such devices are compact and provide for easy manual bending of small diameter conduits. But such devices don'T provide for bending accurate offsets in pipe.

An offset consists of two opposite bends in a length of pipe. It is used when required to move the run of pipe to another plane.

In many installations it is necessary to create a "saddle" which consists of two opposite offsets in a length of pipe. A saddle is used when required to run the conduit around a fixed structure and to return to the same surface. To create a saddle requires two accurately positioned offsets.

The amount of offset required in running pipe is determined by obstacles or building structures in the path of the conduit. While present devices allow a single man to manually make two bends and thereby complete an offset, they don't allow for any gauge as to the amount of offset. The object of my device is to allow the operator to create a given amount of offset without removing the pipe from the bender. One of the prior methods was to use the operator's judgment in determining the proper position to initiate the second bend hopefully to produce the desired offset. In many instances this produced an incorrect offset resulting in scrapped material or an improper installation. Until an operator gained experience at intuitively judging the positioning for the second offset he would have to remove the conduit and measure the offset using a straight edge. This method is very time consuming. I provide a method and means which allows the operator to adapt existing pipe benders for accurate offset bending of pipe and conduit by application of an adhesive tape with incremental markings thereon to the handle, so as to pursue my method.

The method which I provide allows the operator to bend the pipe or tube in the usual way for the first bend of the offset. Then, without removing the pipe from the bender, the next step merely involves turning the pipe through 180°, and sliding the bender along the pipe to the position approximately where the second bend is required. Before making the second bend, the operator sights a line along the bent section of pipe until such sight line intersects the incremental marking on the tape applied to the handle which indicates the amount or offset desired, holds the relation between bender and pipe so attained, and then proceeds to make the second or offset bend of pipe. Since. my method does not require removal of the pipe from the bender to make the second or offset bend, it is possible to quickly and accurately complete both offsets and saddles, without the need for any additional measuring devices and the like.

It is accordingly the object of my invention to provide a method utilizing an adhesive tape with incremental markings, adapted to be applied to existing pipe benders to enable an operator to readily and quickly make offsets and saddles without assistance from any other devices.

To carry out my invention, I provide a tape with adhesive on one side thereof and incremental markings on the other face, which tape may be applied to the handle of existing pipe benders in a manner to enable my method of operation of a pipe bender to be utilized.

The method and means comprising my invention are described hereinafter in detail in connection with the accompanying drawings, wherein:

FIG. 1 is an elevational view of a pipe bender, showing the manner of application thereto of my adhesive tape strip with incremental markings, FIG. 2*a* is a view showing the relative position of pipe and the bender after the first bend operation, and a broken sight line indicating a desired offset measurement at the intersection with the scale on the handle, FIG. 2*b* is a view showing the pipe after the completion of the second bend operation showing the broken sight line, FIG. 3 is a full scale plan view of the adhesive tape with incremental markings thereon, prior to application to the handle of the pipe bender.

Referring to the drawings, FIG. 1 depicts a conventional manual pipe bender 10 of the type comprising a forming head 12 and a handle 13. The forming head is usually made of steel and may be made integral with the handle. The head has a pipe holding groove 12*a* therein of a selected diameter and radius of curvature, the handle 13 being approximately radial to the head from the midpoint of the groove. At one end of the groove in the head is formed a ring, or partial ring 11, by which to hold the pipe in close tangential contact with the end of the forming groove.

The handle 13 is preferably formed with a flat longitudinal surface thereon, or such a surface is ground along the length thereof parallel to the plane of the bender.

In accordance with my invention, I provide a strip of tape 14, of suitable flexible material, such as vinyl or tough plastic sheet material, the strip having an adhesive on one face thereof and a series of incremental markings printed or otherwise imprinted on the other face, with suitable numerals for a particular unit of measurement, illustratively shown as inches though any desired unit of measurement may be provided. To utilize this strip of tape according to my inventive method, the strip is affixed lengthwise to the handle 13, with the lowest dimensional end thereof substantially at the inner radius of curvature of the forming head 12.

The manner and method of utilizing the pipe bender, as modified by the addition of my strip of tape, will now be described by reference to FIGS. 2*a* and 2*b*.

As evident in FIG. 2*a*, a length of pipe 20 was first inserted through the ring 11 and then manually bent over the head to provide the first bend 21. After making the bend 21, the pipe 20 is rotated through 180° and, at the same time, shifted longitudinally to the position as shown in FIG. 2*a*, representative approximately of a desired offset measurement. The operator then accurately determines the point of the second bend, to obtain the offset desired, by sighting along the lower edge of the length of the pipe 20, at the same time adjusting the exact position of the pipe in the ring 11 until the sight line intersects the exact measurement, indicated on the scale of the marked tape, corresponding to the desired offset. At this instant, holding pipe and pipe bender in fixed relation, the operator then exerts the necessary force on the handle to make the second bend 23. FIG. 2*b*shows the offset section of pipe 24 after the second bend has been accomplished, the amount of offset being that between the two parallel sections 20 and 24 of the pipe.

The positions of the incremental markings on the tape are such that for a given jaw and forming head, proper offset results. It has been found after experimentation that for most existing pipe benders a tape scale, such as that shown in FIG. 3, produces accurate results. While this scale shows incremental markings corresponding to 1 through 25 inches such a scale could be constructed to extend to any length handle. The markings for the one inch, two inch and three inch offsets have been determined experimentally. The 1 inch increment as shown on FIG. 3 is approximately ¼ inch from the base of the forming head 12. The two inch increment is approximately one and one-half inches from the forming head 12. The 3 inch increment is approximately three inches from the forming head. For 3 inches and greater, the increments of 1 inch will result in an approximately 1 inch incremental offsets.

While FIG. 3 shows, illustratively, a form of self-adhering adhesive tape, with particular incremental markings, to enable modification of existing pipe benders to utilize my method of performing pipe offset operations, it will be apparent that the incremental markings or scale of markings may be otherwise formed on or cast in the handle or painted directly on the handle. Any other visible form of incremental markings may be utilized in practicing the method of my invention. It should be understood that I claim all modifications or variations of my invention as may be included within the scope of the invention as defined by the appended claims.

I claim:

1. A method for adapting an existing manual pipe bender, of the type having a single forming head and a handle, for performing accurately and readily offset bends, which comprises:

1. providing an adhesive tape having a scale thereon of incremental markings such that:
   a. the first increment, marked 1, is actually one-fourth of an inch from one end,
   b. the second increment, marked 2, is actually one and one-half inches from said one end,
   c. the third increment, marked 3, is approximately 3 inches from said one end,
   d. the fourth and subsequent increments are located at 1 inch intervals from the third increment,
2. applying said tape longitudinally to the handle of the bender such that the said one end of the tape abuts the forming head.

2. A method for utilizing an existing manual pipe bender of the type having a forming head and a handle to perform pipe offset bending operations, which comprises the following steps:

1. providing an adhesive tape with incremental scale markings on the non-adhesive face thereof,
2. applying said tape longitudinally to the handle of the bender such that the end of the tape with the low end of the scale is uppermost and adjacent to the forming head,
3. inserting a length of pipe in the forming head of the bender and making a first bend therein where desired,
4. rotating the pipe to a position in which the projection of the bent section of pipe intersects the handle perpendicularly,
5 sliding the pipe to a position such that, when sighting along the bent section of pipe, the sight line intersects the scale markings on the tape at the desired offset distance, and
6. bending the pipe a second time while pipe and bender are fixed in position attained in step (5.)

3. In a manual pipe bender of the type having a single forming head and a handle, extending substantially radially therefrom, the improvement which comprises applying to the said handle an adhesive tape having on its outer face a scale of incremental markings such that:

a. the first increment, marked 1, is actually one-fourth of an inch from one end of the tape,
b. the second increment, marked 2, is actually one and one-half inches from the forming head,
c. a third increment, marked 3 is approximately three inches from the forming head, and
d. the fourth and subsequent increments are located at 1 inch intervals from the third increment.

4. An adhesive tape for use in modifying an existing manual pipe bender to enable it to perform readily and quickly pipe offset bending operations, which tape comprises a self-adhering adhesive on one face thereof and a scale on the opposite face thereof, said scale having incremental markings such that:

a. the first incremental mark, marked 1, is actually one-fourth of an inch from one end of the tape,
b. the second incremental mark, marked 2, is actually one and one-half inches from said one end of the tape,
c. the third incremental mark, marked 3, is substantially three inches from said one end of the tape, and
d. the fourth and subsequent incremental marks, marked 4, 5, etc., are located at 1-inch intervals from the third incremental mark.

* * * * *

UNITED STATES PATENT OFFICE

CERTIFICATE OF CORRECTION

Patent No. 4,063,444 Dated December 20, 1977

Inventor(s) JOHN B. VECHO, JR.

It is certified that error appears in the above-identified patent and that said Letters Patent are hereby corrected as shown below:

Column 1, line 18, "don'T" should read --don't--.

Column 1, line 59, "or" should read --of--.

Column 3, line 4, "2bshows" should read --2b shows--.

Column 4, Claim 3, line 32, "one end of the tape," should read --the forming head,--.

Column 4, Claim 3, line 35, after "3" insert a comma

Signed and Sealed this

Ninth Day of May 1978

[SEAL]

Attest:

RUTH C. MASON
Attesting Officer

LUTRELLE F. PARKER
Acting Commissioner of Patents and Trademarks